United States Patent [19]

Gold

[11] 4,035,020

[45] July 12, 1977

[54] FURNITURE CONSTRUCTION

[76] Inventor: Donald B. Gold, 260 Canal St., San Rafael, Calif. 94901

[21] Appl. No.: 640,679

[22] Filed: Dec. 15, 1975

Related U.S. Application Data

[62] Division of Ser. No. 504,061, Sept. 9, 1974.

[51] Int. Cl.[2] ..... A47C 3/02

[52] U.S. Cl. ..... 297/258; 108/161; 248/345.1; 297/130; 297/135; 297/355; 297/377; 297/440

[58] Field of Search ..... 108/161; 52/716–718; 248/345.1; 297/130, 258, 355, 363, 377, 420, 421, 440, 443, 445, 450, 452, 463

[56] References Cited

U.S. PATENT DOCUMENTS

| | | | |
|---|---|---|---|
| 1,353,066 | 9/1920 | Pascoe | 297/258 X |
| 2,918,107 | 12/1959 | Cote | 297/377 X |
| 3,460,866 | 8/1969 | Kessel | 297/258 |
| 3,899,208 | 8/1975 | Cirigliano | 297/258 |

*Primary Examiner*—James C. Mitchell
*Attorney, Agent, or Firm*—Phillips, Moore, Weissenberger, Lempio & Majestic

[57] ABSTRACT

A furniture construction, such as a chair, table or foot stool, may be made by cutting a flat circular member into a plurality of panels along chordal lines thereof. The chair, for example, may be formed out of four identical panels, as defined by first and second perpendicular pairs of parallel chordal cut lines. In assembling the chair, seat and back panels are clamped between a pair of laterally spaced side panels by a plurality of tie rods and the back panel is adjustably mounted on the seat panel. In the preferred embodiment of this invention, the edges of the panels are each covered by cushioned edging means comprising a plurality of first fibrous ropes extending the full length of such edge and a second continuous fibrous rope extending sequentially through a plurality of apertures spaced along and inwardly of the edge in spiralled and wrapped relationship over the first ropes to bind them against the panel.

28 Claims, 17 Drawing Figures

FIG. 1.
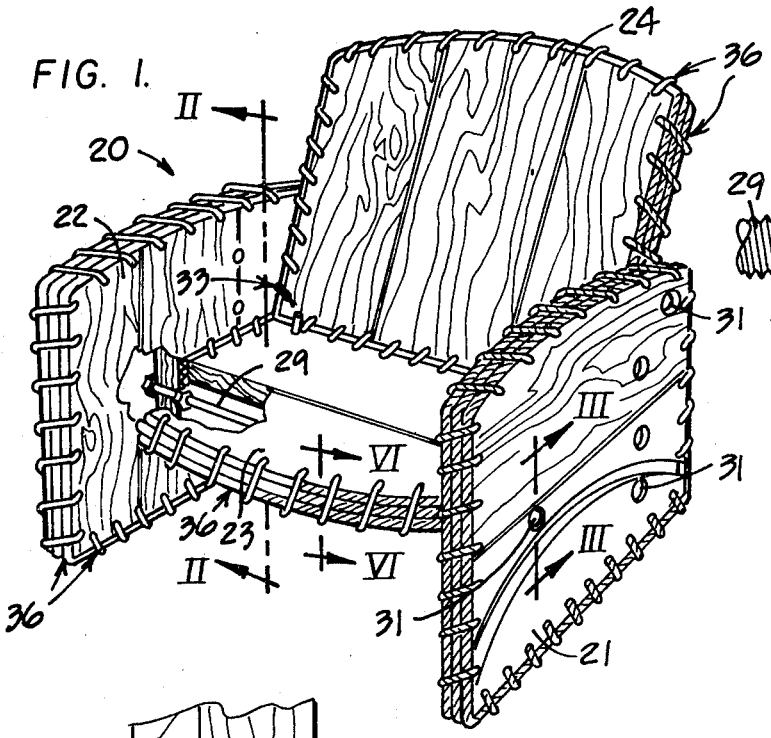
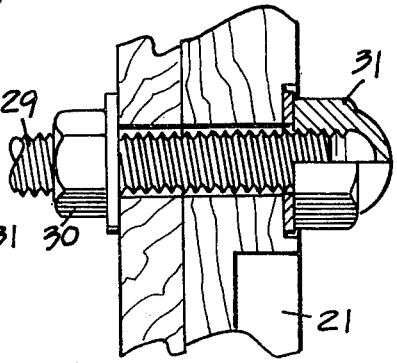
FIG. 3.
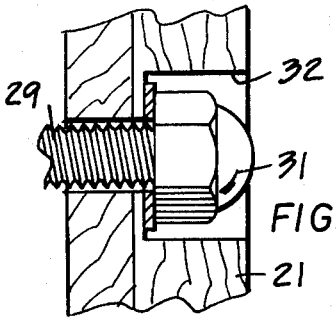
FIG. 4.
FIG. 2.
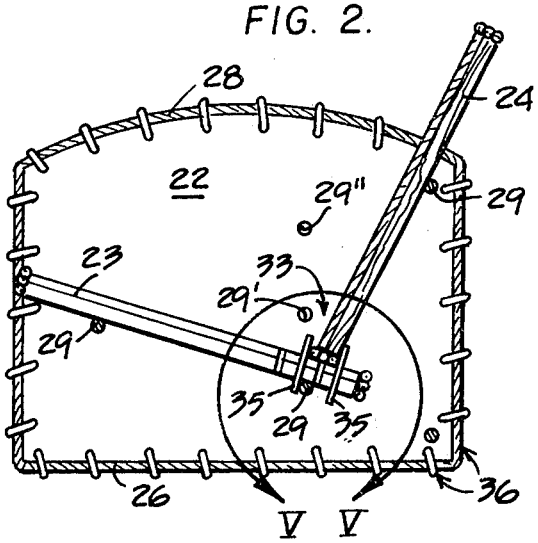
FIG. 7.
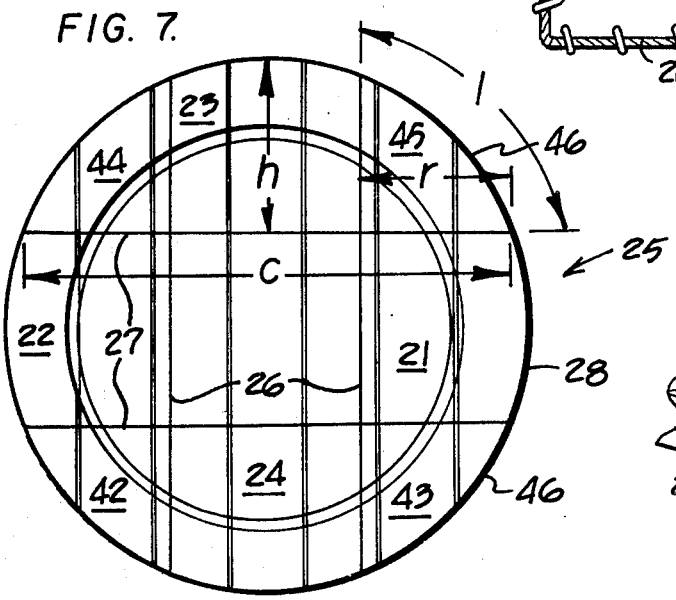
FIG. 5.
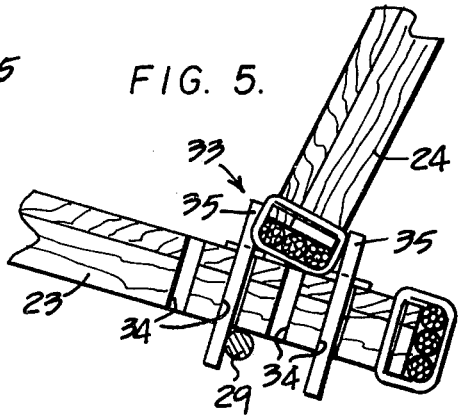

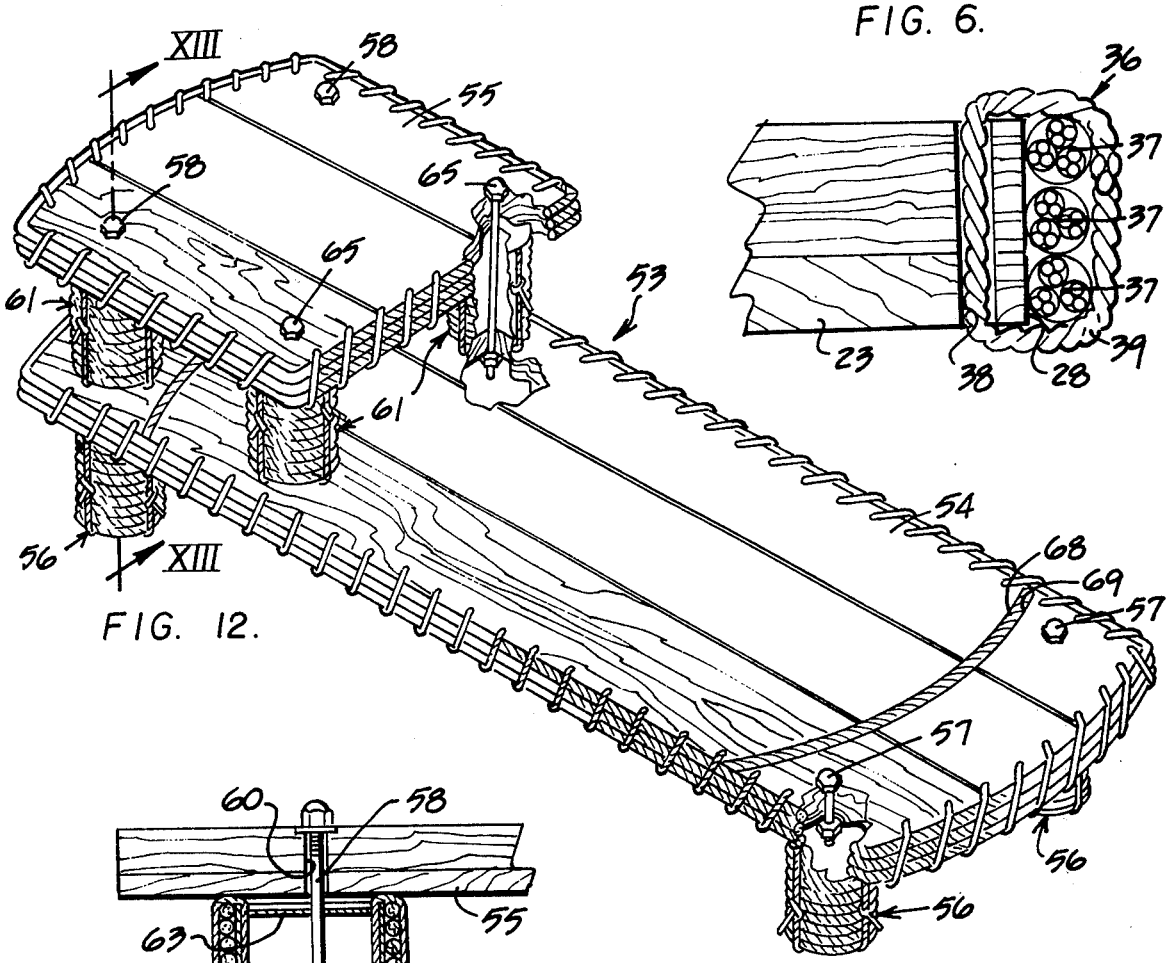
FIG. 12.
FIG. 6.
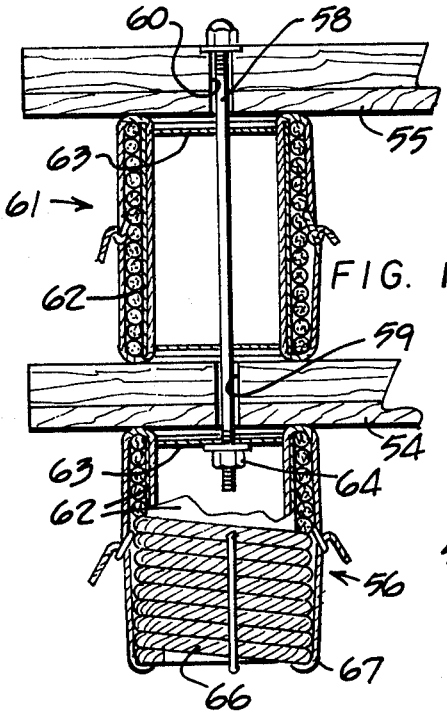
FIG. 13.
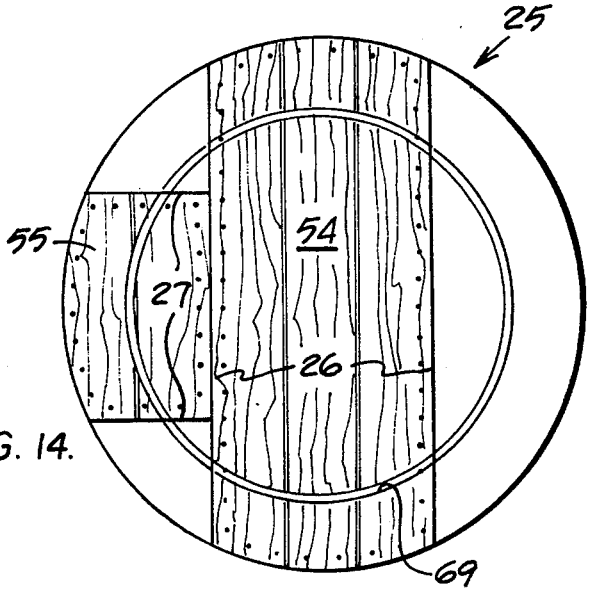
FIG. 14.

FIG. 8.
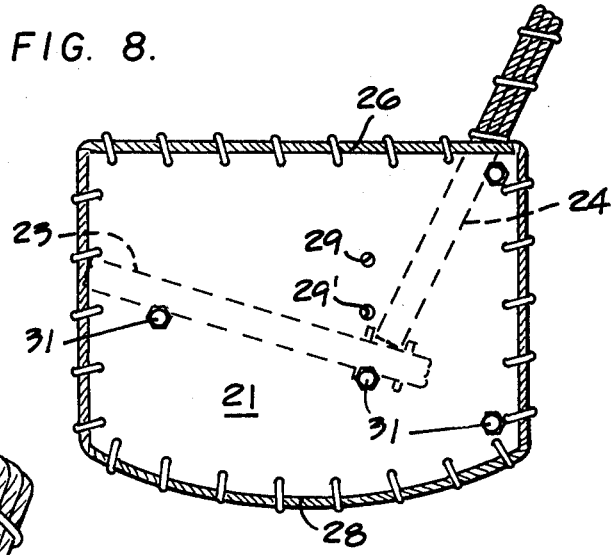
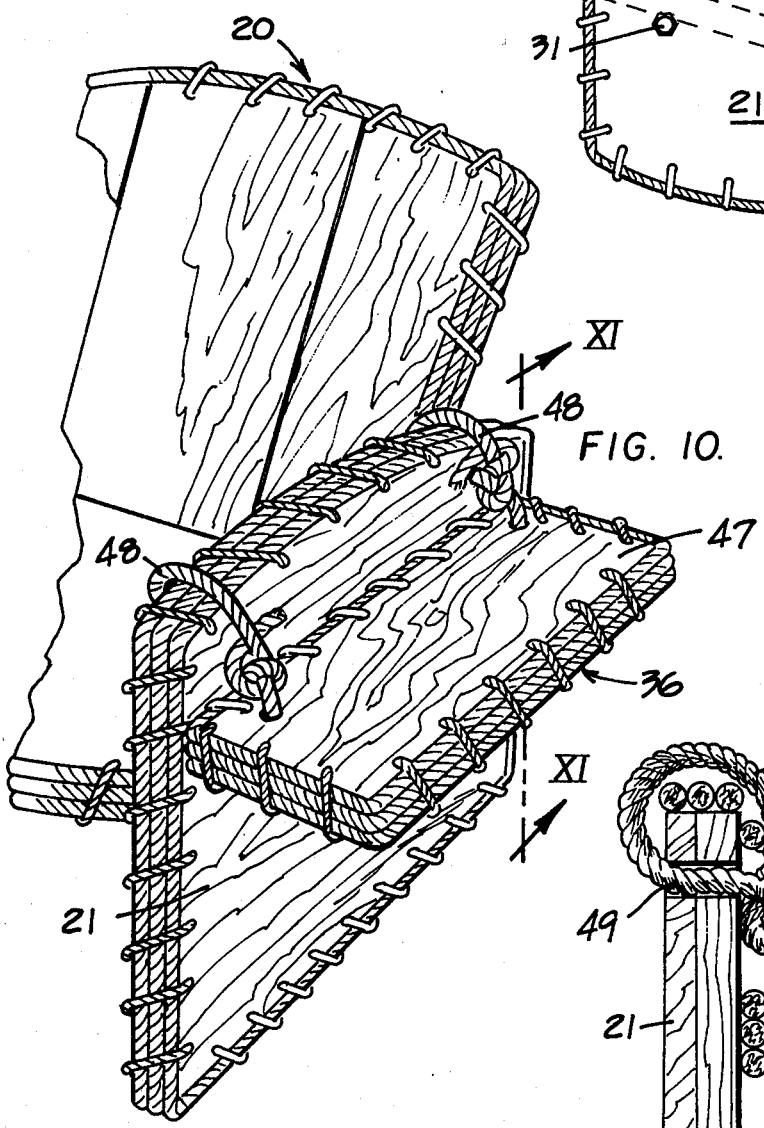
FIG. 10.
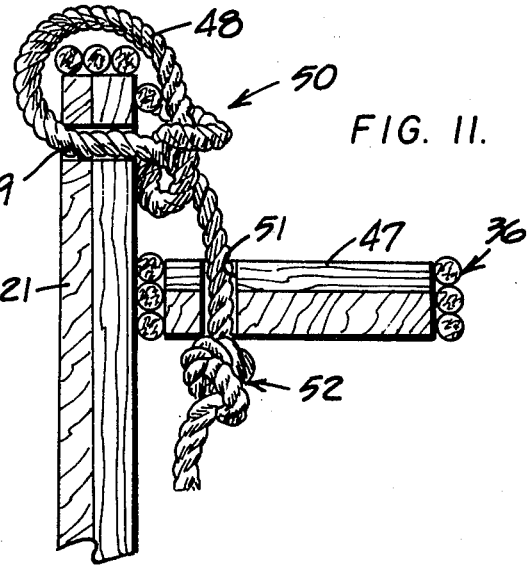
FIG. 11.

FURNITURE CONSTRUCTION

This is a division of Ser. No. 504,061, filed Sept. 9, 1974.

BACKGROUND OF THE INVENTION

The relative complexity of conventional furniture constructions has made them difficult to manufacture as well as expensive to purchase by the average consumer. In addition, a particular furniture construction is not adaptable to multi-purpose uses, such as conversion from a chair construction to a table construction. In addition, the exposed edges of conventional wooden furniture constructions are prone to damage and subject a user to possible injury by contact therewith or by splinters exposed on such edges.

SUMMARY OF THIS INVENTION

An object of this invention is to provide an economical and non-complex furniture construction which exhibits a long service life and adaptability of its panels to multiple uses. The furniture construction may comprise a chair, bench, foot stool, table or the like formed out of a flat, circular member by cutting the member into a plurality of panels along chordal lines thereof and thereafter attaching the panels together.

In the preferred embodiment of this invention, a cushioned edging means is secured on at least one edge of each panel. Such cushioned edging means comprises a plurality of first fibrous ropes extending the full length of such edge and in abutting relationship with respect to each other. A plurality of apertures are spaced along and inwardly of the edge and are formed completely through the panel. A second continuous fibrous rope extends sequentially through the apertures in spiralled and wrapped relationship over the first ropes to bind them against the edge of the panel.

One furniture construction embodiment of this invention comprises a chair composed of a pair of upright and laterally spaced side panels, a horizontally disposed seat panel and a generally upright back panel having its lower end adjustably mounted on a back side of the seat panel. The seat and back panels may be clamped between the side panels to facilitate expeditious assembly and disassembly thereof. The various panels constructed in accordance with the teachings of this invention are adapted for multi-purpose uses, such as for chair, couches, foot stools, tables and the like.

BRIEF DESCRIPTION OF THE DRAWINGS

Other objects of this invention will become apparent from the following description and accompanying drawings wherein:

FIG. 1 is a front perspective view of a chair embodiment of this invention;

FIG. 2 is a sectional view of the chair, taken generally in the direction of arrows II—II in FIG. 1;

FIG. 3 is an enlarged sectional view of a portion of a tie rod, taken in the direction of arrows III—III in FIG. 1;

FIG. 4 is a view similar to FIG. 3, but showing a modification of a nut employed on the tie rod for attaching panels of the FIG. 1 chair together;

FIG. 5 is an enlarged sectional view taken within circle V—V in FIG. 2;

FIG. 6 is an enlarged sectional view of a cushioned edging means taken in the direction of arrows VI—VI in FIG. 1;

FIG. 7 is a top plan view of a circular wooden member adapted to be cut into a plurality of panels for use in assembling the FIG. 1 chair;

FIG. 8 is a side elevational view of a rocking chair embodiment of this invention, comprising the panels employed for the FIG. 1 chair;

FIG. 10 is an enlarged perspective view of a portion of the FIG. 1 chair having a shelf attached to one side panel thereof;

FIG. 11 is an enlarged sectional view of a rope attachment means for attaching the shelf to the side panel of the FIG. 10 chair, taken generally in the direction of arrows XI—XI in FIG. 10;

FIG. 12 is a perspective view of a table embodiment of this invention;

FIG. 13 is an enlarged sectional view taken in the direction of arrows XIII—XIII in FIG. 12;

FIG. 14 is a top plan view of a circular wooden member, similar to the FIG. 7 member, adapted to be cut into a plurality of panels for use in assembling the FIG. 12 table;

DETAILED DESCRIPTION

Figure 15:
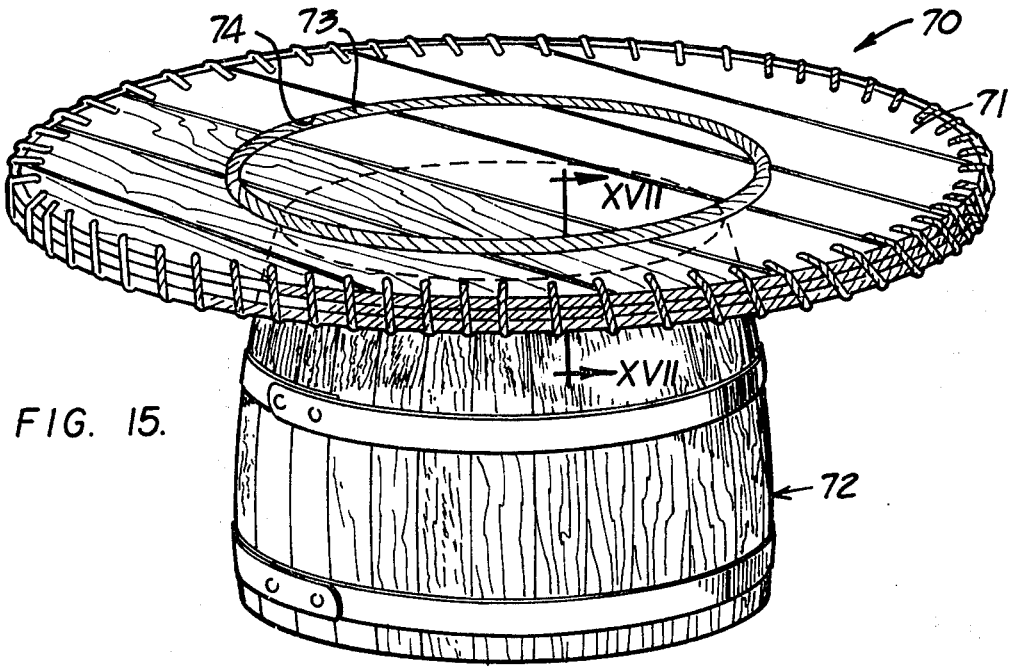
FIG. 15 is a front isometric view of a second table embodiment of this invention.

FIG. 1 illustrates a chair embodiment 20 of this invention comprising a pair of upright and laterally spaced side panels 21 and 22, a horizontally disposed seat panel 23 and a generally upright back panel 24. Such panels may be suitably cut out of a circular member 25, illustrated in FIG. 7. Such member preferably comprises a laminated wood construction such as that employed for the opposite ends of a conventional spool used for winding large cables and the like thereon.

The method for making the FIG. 1 chair embodiment comprises steps of forming the flat, circular member 25 to size and thereafter cutting the member into a plurality of identical panels 21-24 along pairs of chordal lines 26 and 27 also defining straight edges on the panels. Each pair of chordal cut lines are disposed in parallel relationship with respect to each other and are further disposed perpendicular relative to the other pair of chordal lines to further define sectors or panels 42-45, hereinafter more fully described.

The cutting step comprises cutting the circular member to define each panel 21-24, between a respective pair of segments, by an area in accordance with the formula $A = [hc - r\ (1+c)]2$ wherein:

$h$ = the diametric height of a panel;

$c$ = the chordal length of a respective segment;

$r$ = the radius of a respective sector; and $l$ = the circumferential length of the arcuate edge of such sector.

The panels are releasably attached together by clamping the seat and back panels between side panels 21 and 22 by a plurality of identical tie rods 29 extending therebetween and therethrough. As shown in FIG. 2, a pair of spaced tie rods underlie the seat panel and a single tie rod is disposed in supporting relationship at a back side of a back panel. As shown in FIG. 3, each end of each tie rod is attached to a respective side panel by a pair of nuts 30 and 31 threadably mounted on the tie rod and disposed on either side of the side panel.

In the FIG. 3 embodiment, nut 31 is disposed on an outboard side of a side panel to extend outwardly from the outer wall of the panel in exposed relationship thereon. FIG. 4 discloses a modification thereof wherein nut 31 is further disposed in a recessed bore 32 formed in the side panel to dispose the outer end of the nut substantially flush with respect to the outer wall of the panel. It should be understood that the tie rods can be adjusted to: (1) Tightly clamp the seat and back panels between the side panels; (2) apply an intermediate clamping pressure thereto to permit a person sitting in the chair to apply a back pressure to the back panel to selectively vary the inclination thereof; or (3) loosely mount the seat and back panels between the clamped together side panels.

Referring to FIG. 2, adjustment means 33 are provided on a back side of the seat panel to selectively vary the inclination of the back panel relative to the seat panel. Such adjustment means, more clearly shown in FIG. 5, may comprise a plurality of holes 34 formed in the seat panel on each lateral side thereof. A pair of removable locating pegs are disposed in a selected pair of the holes and are further disposed on either side of a lower end of the back panel to retain it in a selected position on the seat panel.

Referring to FIGS. 1 and 6, each edge of each panel is preferably completely covered with cushioned edging means 36 to protect such edges as well as to protect a user from injury due to splinters or the like. The cushioned edging means comprises at least one first fibrous rope 37 (preferably three) at least substantially covering edge 28, for example, and extending the full length thereof. A plurality of apertures 38 are equally spaced along and inwardly of edge 28 and formed completely through the panel.

A continuous second fibrous rope 39 extends sequentially through the apertures in spiralled and wrapped relationship over the first ropes to bind them against edge 28 of the panel. It should be noted that side panels 21 and 22 of the above-described chair are disposed to have straight edges 26 positioned at the lower ends thereof, opposite to arcuate edges 28 (FIG. 2). FIG. 8 discloses a reversal of the side panels to position arcuate edges 28 at lower ends thereof to form a rocking chair. The FIG. 8 rocking chair is otherwise constructed and arranged substantially similar to the FIG. 1 chair embodiment except that the rearward tie rod 29, supporting the seat panel, is repositioned in holes 29'' formed through the side panels (FIG. 2). Holes 29' may accommodate such tie rod to dispose seat panel 23 horizontally on the chair or to form a bench (wherein back panel 24 is eliminated).

Figure 9:
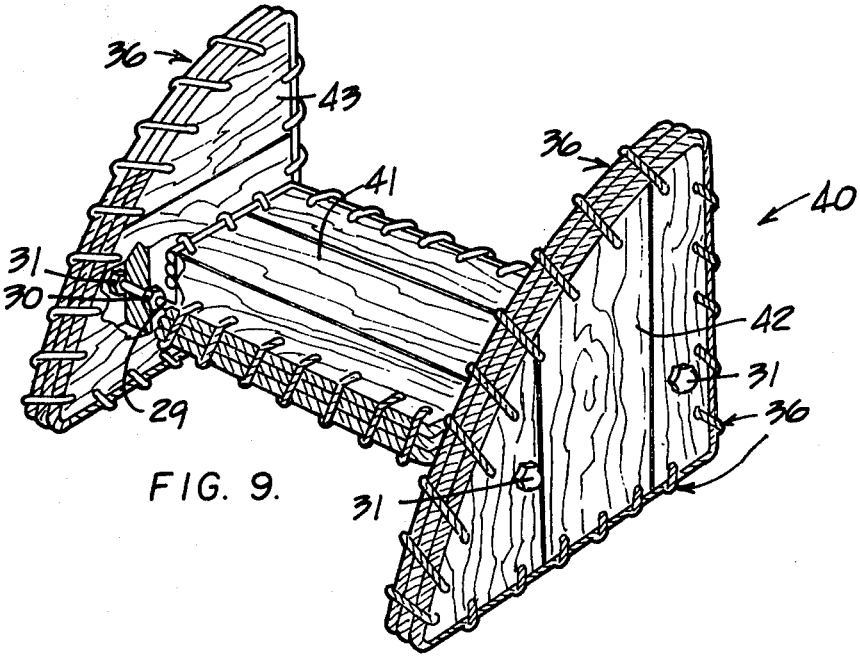
FIG. 9 is a front perspective view of a foot stool comprising a plurality of panels cut out of the FIG. 7 circular member.

FIG. 9 discloses a foot stool or shelf embodiment 40 which may also be constructed out of panels formed from the FIG. 7 circular member 25. In particular, such member further comprises a centrally disposed and rectangular (preferably square) panel 41 and four identical sectors or panels 42, 43, 44 and 45. Each of the latter panels is defined by an area A, in accordance with the formula $A = rl/2$ wherein:

$r$ = the radius of a respective panel; and $l$ = the circumferential length of an arcuate edge 46 of such panel.

Two such panels 42 and 43, for example, may be disposed in an upright position to have panel 41 clamped therebetween by a pair of tie rods 29. Each edge of each panel is preferably also covered with a cushioned edging means 36, described above.

FIGS. 10 and 11 illustrate a shelf 47 attached to an upper end of side panel 21 to provide an arm and/or beverage rest. It should be understood that a second shelf (not shown) could be likewise attached to second side panel 22 (not shown) of the chair. The shelf is held in a horizontally disposed position by a pair of ropes 48 attached adjacent to each longitudinal end thereof.

Referring to FIG. 11, each rope 48 is looped through a bore 49 formed through side panel 21 and is attached to the side panel at a knot 50. A free end of the rope extends through a bore 51 formed through the shelf and terminates at its lower end at a knot 52, underlying the shelf to hold it in position against the side panel. Each edge of the shelf is preferably covered with a cushioned edging means 36 in the manner aforedescribed. The shelf may be suitably cut out of a circular member 25 (FIG. 7) along with other suitably sized panels.

FIGS. 12 and 13 illustrate an end table embodiment 53 comprising a lower panel 54 having an upper panel 55 secured in elevated relationship thereon. Panel 54 may be attached to four legs 56, each disposed beneath a respective corner of the panel. The front legs are each attached to the panel by a bolt 57 whereas the rear legs are each attached to panels 54 and 55 by an elongated bolt or tie rod 58.

As shown in FIG. 13, each bolt 58 extends through aligned apertures 59 and 60 formed through panels 54 and 55 respectively, and through a cylindrical spacer 61 supporting panel 55 on panel 54. Each leg 56 and spacer 61 may comprise a metallic cylindrical member 62, such as an empty 1-gallon paint can closed at one end by an end wall 63. Bolt 58 further extends through apertures suitably formed through end walls 63 of the cans and is secured beneath the end wall of the bottom can by a nut 64 threadably mounted on the bolt. The forwardly disposed spacers 61 are secured in a similar manner between the panels by bolts 65.

Each leg 56 and spacer 61 is preferably spiral wrapped with a first fibrous rope 66 secured in place by a plurality of axially extending second fibrous ropes 67 suitably looped through apertures suitably formed through end walls 63 of the cans and around side walls thereof. In addition, the above-described cushioned edging means 36 (FIG. 6) is preferably applied to each edge of panels 54 and 55. Also, an arcuately shaped fibrous rope 68 may be disposed in a like-shaped channel 69 formed at a forward end of panel 54 to prevent glasses or the like from sliding-off the panel.

FIG. 14 partially illustrates a circular member identical to member 25 (FIG. 7) adapted to be cut at chord lines 26 and 27 thereof which further define straight edges of the two panels. It can be seen that panel 55 is identical to each panel 42–45, employed to make the FIG. 1 chair, whereas panel 54 constitutes a unitary member conforming to the composite shape of panels 22, 24 and 41. It should be further noted that arcuate channel or groove 69 is formed on a circle defined by a radius less than the radius defining the circumference of the circular member.

Figure 17:
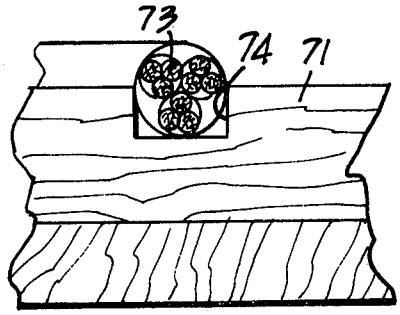
FIG. 17 is an enlarged sectional view of the table taken in the direction of arrows XVI—XVI in FIG. 15.
Figure 16:
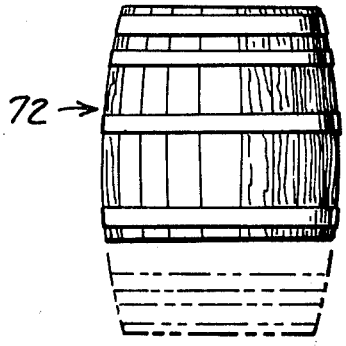
FIG. 16 is a reduced front elevational view of a barrel member employed in the FIG. 15 table embodiment, further illustrating by phantom lines a possible lengthening thereof.

FIG. 15 illustrates a table emnbodiment 70 comprising a panel 71 (identical to member 25 in FIG. 7) suitably mounted on a barrel 72. As shown in FIG. 16, barrel 72 may be shortened to its FIG. 15 length or may be lengthened to its full vertical height, as illustrated by phantom lines therein. As shown in FIG. 17, panel 71 preferably has cushioned edging means 36 secured therearound and a circular rope 73 disposed in a like-shaped groove 74 formed on panel 71.

I claim:

1. In a furniture construction comprising a plurality of members attached together, the invention wherein at least one of said members comprises a panel having cushioned edging means secured on at least one edge thereof, said cushioned edging means comprising at least one continuous first fibrous rope at least substantially covering said edge and extending the full length of said edge, a plurality of apertures spaced along and inwardly of said edge and formed completely through said panel and a continuous second fibrous rope extending sequentially through said apertures in spiralled and wrapped relationship over said first rope to bind said first rope against the edge of said panel.

2. The furniture construction of claim 1 wherein each edge of each of said panels has a cushioned edging means secured thereon.

3. The furniture construction of claim 1 wherein a plurality of said first fibrous ropes completely cover said edge in abutting relationship to each other.

4. The furniture construction of claim 1 wherein at least one of said panels comprises straight and curved edges disposed in transverse, intersecting relationship and wherein said cushioned edging means is continuous and completely covers said straight and curved edges.

5. The furniture construction of claim 4 wherein said panels comprise a pair of upright and laterally spaced side panels, at least one horizontally disposed seat panel attached between said side panels and an at least one generally upright back panel having its lower end disposed on a back side of said seat panel and attached between said side panels.

6. The furniture construction of claim 5 wherein only one seat panel and only one back panel are attached between said side panels to form a chair.

7. The furniture construction of claim 6 wherein the lower edge of each of said side panels is straight.

8. The furniture construction of claim 6 wherein the lower edge of each of said side panels is arcuate to form a rocking chair.

9. The furniture construction of claim 5 wherein said seat and back panels are solely clamped between said side panels.

10. The furniture construction of claim 9 wherein said side panels are clamped together by a plurality of tie rods extending therebetween.

11. The furniture construction of claim 10 wherein a pair of spaced tie rods underlie said seat panel and a single tie rod is disposed in supporting relationship at a back side of said back panel.

12. The furniture construction of claim 11 wherein each end of each of said tie rods is attached to a respective side panel by a pair of nuts threadably mounted on such end and disposed on either side of such respective side panel.

13. The furniture construction of claim 12 wherein each nut disposed on an outboard side of each side panel extends outwardly therefrom.

14. The furniture construction of claim 12 wherein each nut disposed on an outboard side of each side panel is further disposed in a recessed bore formed in a respective side panel.

15. The furniture construction of claim 5 further comprising adjustment means on the back side of said seat panel for selectively varying the inclination of said back panel relative to said seat panel.

16. The furniture construction of claim 15 wherein said adjustment means comprises a plurality of holes formed in said seat panel and a pair of locating pegs disposed in a pair of said holes and on either side of the lower end of said back panel.

17. A furniture construction comprising a pair of upright and laterally spaced side panels, at least one horizontally disposed seat panel disposed between and solely abutting inner surfaces of said side panels in non-attached relationship therewith, at least one generally upright back panel having its lower end solely resting on a back side of said seat panel in non-attached relationship therewith and attachment means releasably clamping said side panels together comprising a plurality of tie rods underlying said seat and back panels and adjustably secured between said side panels for clamping said seat and back panels therebetween whereby release of said tie rods will permit selective adjustment of said seat and back panels relative to said side panels.

18. The furniture construction of claim 17 wherein only one seat panel and only one back panel are tightly clamped between said side panels by said tie rods to form a chair.

19. The furniture construction of claim 18 wherein the lower edge of each of said side panels is straight.

20. The furniture construction of claim 18 wherein the lower edge of each of said side panels is arcuate to form a rocking chair.

21. The furniture construction of claim 17 wherein said tie rods comprise a pair of spaced tie rods underlying said seat panel with one of said pair of tie rods underlying a front side of said seat panel and a second one of said pair of tie rods underlying the back side of said seat panel and substantially underlying said back panel and a single tie rod disposed in supporting relationship at a back side of said back panel.

22. The furniture construction of claim 21 wherein each end of each of said tie rods is attached to a respective side panel by a pair of nuts threadably mounted on such end and disposed on either side of such respective side panel.

23. The furniture construction of claim 22 wherein each nut disposed on an outboard side of each side panel extends outwardly therefrom.

24. The furniture construction of claim 22 wherein each nut disposed on an outboard side of each side panel is further disposed in a recessed bore formed in a respective side panel.

25. The furniture construction of claim 17 further comprising adjustment means on the back side of said seat panel for selectively varying the inclination of said back panel relative to said seat panel.

26. The furniture construction of claim 25 wherein said adjustment means comprises a plurality of holes formed in said seat panel and a pair of laterally spaced locating pegs extending entirely through a pair of said holes to have upper ends thereof disposed on either side of the lower end of said back panel and lower ends thereof disposed on either side of one of said tie rods.

27. A furniture construction comprising a pair of upright and laterally spaced side panels, at least one horizontally disposed seat panel disposed between said side panels, at least one generally upright back panel having its lower end disposed on a back side of said seat panel and adjustment means cooperating between the back side of said seat panel and a lower end of said back panel for selectively varying the inclination of said back panel relative to said seat panel comprising a plurality of holes formed in said seat panel and disposed on each lateral side thereof and adjacent to a respective one of said side panels and a pair of locating pegs disposed in a pair of holes of each of said plurality of holes and having upper ends thereof disposed on either side of the lower end of said back panel.

28. The furniture construction of claim 27 further comprising at least one rod secured between said side panels in underlying relationship with said seat panel and wherein lower ends of each pair of said locating pegs are disposed on either side of said rod.

* * * * *